US005271361A

United States Patent [19]

Flynn

[11] Patent Number: 5,271,361

[45] Date of Patent: Dec. 21, 1993

[54] ENGINE CONDITIONING APPARATUS AND METHOD

[76] Inventor: Robert E. Flynn, 953 N. Greer Ave., Covina, Calif. 91724

[21] Appl. No.: 851,656

[22] Filed: Mar. 16, 1992

[51] Int. Cl.[5] ..... F02B 77/00

[52] U.S. Cl. ..... 123/198 A; 134/169 A; 417/2

[58] Field of Search ..... 123/1 A, 198 A; 134/169 A; 417/2, 205

[56] References Cited

U.S. PATENT DOCUMENTS

| | | | |
|---|---|---|---|
| 1,039,749 | 10/1912 | Ingram | 137/521 |
| 1,556,332 | 10/1925 | Gorman | 137/521 |
| 1,635,842 | 7/1927 | Hirshstein | 137/521 |
| 4,204,808 | 5/1980 | Reese et al. | 417/2 |

FOREIGN PATENT DOCUMENTS

| | | | |
|---|---|---|---|
| 3308891 | 9/1984 | Fed. Rep. of Germany | 417/2 |

*Primary Examiner*—Noah P. Kamen

*Attorney, Agent, or Firm*—Boniard I. Brown

[57] ABSTRACT

Carbon deposits and related residue and contaminants are removed from the fuel ports and internal surfaces of an internal combustion engine fuel system, particularly fuel injectors, carburetors, fuel pumps, fuel passages, and the like, by initially utilizing a priming pump to pump priming fuel to the engine from an external fuel source while the engine is being cranked to start the engine and then utilizing the engine fuel pump to pump a combustible, carbon removing conditioning fuel from the fuel source through the engine fuel system along a flow path which by-passes the priming pump so as to avoid restriction of the conditioning fuel flow by the priming pump and thereby increase the conditioning fuel flow rate sufficiently to permit simultaneous servicing of several engines.

29 Claims, 1 Drawing Sheet

ENGINE CONDITIONING APPARATUS AND METHOD

BACKGROUND OF THE INVENTION

1. Field of the Invention

This invention relates generally to the art of servicing internal combustion engines and more particularly to a novel engine conditioning apparatus and conditioning method for priming and cleaning internal carbon deposits and related residue and contaminants from such engines.

2. Related Applications

Reference is made to my copending application Ser. No. 07/666,390, filed Mar. 8, 1991, and entitled Method and Apparatus For Cleaning Deposits and Residue From Internal Combustion Engines.

3. Prior Art

This invention and that disclosed in my above referenced copending application are concerned with curing certain well known operating problems associated with internal combustion engines including both carburetted engines and fuel injected engines. One of these problems resides in the fact that during engine operation, deposits of carbon and related residue and contaminants, hereafter referred to simply as carbon deposits, form on the internal engine surfaces including, particularly, the internal carburetor fuel port surfaces of carburetted engines and the internal fuel injector surfaces of fuel injected engines. Unless removed at regular intervals, these carbon deposits can build up sufficiently to seriously degrade engine performance and possibly even totally clog at least the relatively small fuel passages in fuel injectors and carburetors.

Various engine conditioning procedures and systems have been devised for removing such internal carbon deposits. One known engine conditioning procedure, for example, involves disassembly of an engine and individual cleaning of the engine parts. This engine cleaning procedure is obviously complex, time consuming, costly, and requires the services of highly skilled personnel. Never-the-less, the procedure has one inherent advantage. This advantage resides in the fact that it solves one problem involved in all carbon removal procedures, namely reliable determination of the effectiveness of the carbon removal procedure, i.e. reliable determination of the cleanliness of the engine fuel passages. Thus, disassembly of the engine permits direct inspection of the engine parts and thereby accurate visual determination of their cleanliness.

U.S. Pat. No. 4,787,348 discloses an alternative engine conditioning procedure which eliminates the need to disassemble the engine and thereby the disadvantages of such disassembly. This alternative conditioning involves the circulation of a carbon cleaning or disolving agent through the engine.

Another problem involved in the conditioning of internal combustion engines, particularly diesel engines and other fuel injected engines, to remove their internal carbon deposits is loss of prime as a result of entrance of air into the engine fuel lines during connection of the conditioning apparatus to and disconnection of the conditioning apparatus from the engine fuel system. The existing carbon removal procedures and apparatus of which I am aware do not solve this problem, at least in an effective manner.

My above referenced copending application discloses an improved engine conditioning method and apparatus for both removing internal carbon deposits from internal combustion engines, particularly from the fuel injectors of fuel injected engines and from the carburetors of carburetted engines, and priming the engine. The invention disclosed in my prior application cleans carbon deposits from an internal combustion engine by circulating through the engine fuel system, while the engine is running, a combustible engine conditioning or cleaning fuel capable of both cleaning carbon deposits from the engine and powering the engine by combustion in the engine cylinders. This conditioning fuel flows through and cleans internal carbon deposits from the engine fuel system, including, particularly, its fuel pump and fuel input means, i.e. fuel injectors or carburetor, after which the conditioning fuel is introduced into and combusted in the engine cylinders to power the engine.

The preferred engine conditioning apparatus disclosed in my copending application is designed for quick connection to and disconnection from an automobile internal combustion engine of the kind whose fuel pump delivers fuel at a rate exceeding the total fuel inflow rate into the engine cylinders. The excess fuel output from the fuel pump is utilized to cool and lubricate the fuel pump and the fuel input means, i.e. fuel injectors or carburetor, as the case may be, and is then recycled back to the engine fuel pump. The diesel engine system described in my U.S. Pat. No. 4,479,465 is such an engine system. In this patented engine system, the recycled excess fuel from the engine is combined, within a fuel relay valve or manifold, with incoming fresh fuel from the engine fuel tank.

Another feature of the engine conditioning invention disclosed in my copending application resides in its inclusion of a priming pump for priming the engine with normal engine fuel only or with the combustible engine conditioning fuel by feeding the engine fuel or conditioning fuel, as the case may be, to the engine fuel pump. This priming pump is operable to initially pump the fuel to the engine to start the engine after which the engine fuel pump takes over to pump conditioning fuel through the engine. In the case of an engine whose fuel pump delivers excess fuel for cooling and lubricating purposes, the excess fuel is returned to a fuel receiver and is then recycled back to the engine.

SUMMARY OF THE INVENTION

This invention provides an improved engine conditioning method and apparatus of the kind disclosed in my copending application. The improvements of the present invention are concerned with increasing the maximum conditioning fuel delivery rate of the invention sufficiently to permit several internal combustion engines to be conditioned simultaneously by a single common engine conditioning apparatus.

In the engine conditioning apparatus of my prior application, conditioning fuel flow between the conditioning apparatus and the engine occurs through the priming pump throughout the entire engine conditioning operation from start to finish. Thus, during the engine priming phase of the apparatus, the priming pump is operated to pump fuel to the engine to start the engine. The engine fuel pump then takes over to pump conditioning fuel through the priming pump to the engine to power the engine during the remaining major portion of the engine conditioning process. Remaining in the fuel flow path, as it does, the priming pump restricts the flow of conditioning fuel to the engine and thereby the maximum conditioning fuel delivery rate of the engine conditioning apparatus. As a consequence, an engine conditioning apparatus of the kind disclosed in my prior application is normally operable to service only one engine at a time.

My present invention provides an improved engine conditioning method and apparatus which are similar to those of my copending appliction but which eliminate the above discussed conditioning fuel restriction imposed by the priming pump of the prior apparatus. Elimination of this priming pump flow restriction, in turn, substantially increases the maximum conditioning fuel delivery rate of the conditioning apparatus and permits several engines to be conditioned simultaneously by a single conditioning apparatus.

To this end, the present improved engine conditioning invention includes a by-pass around the priming pump which is closed during operation of the pump to prime the engine(s) being conditioned and which is opened upon starting of the engine(s) to by-pass the conditioning fuel aroung the priming pump. The priming pump thus creates no fuel flow restriction during the remaining major portion of the engine conditioning process. In the disclosed preferred embodiment of the invention, this by-pass comprises a by-pass valve which closes in response to operation of the priming pump and opens in response to operation of the engine fuel pump(s) by starting of the engine(s) being conditioned.

It will become evident as the description proceeds that the engine conditioning apparatus of the present invention, like that of my copending application, can be incorporated as a permanent part of an engine system. The preferred conditioning apparatus of the present invention, however, is a separate external apparatus having quick disconnect couplings for connection to the engine fuel lines of the engine(s) being serviced and then disconnected from the engine(s) at the conclusion of the conditioning process. The disclosed embodiment of the conditioning apparatus is designed to condition several engines at one time.

BRIEF DESCRIPTION OF THE DRAWING

The single figure of the drawing diagramatically illustrates an engine conditioning apparatus according to the invention operatively coupled to several internal combustion engines to be cleaned.

DESCRIPTION OF THE PREFERRED EMBODIMENT

Figure 1:
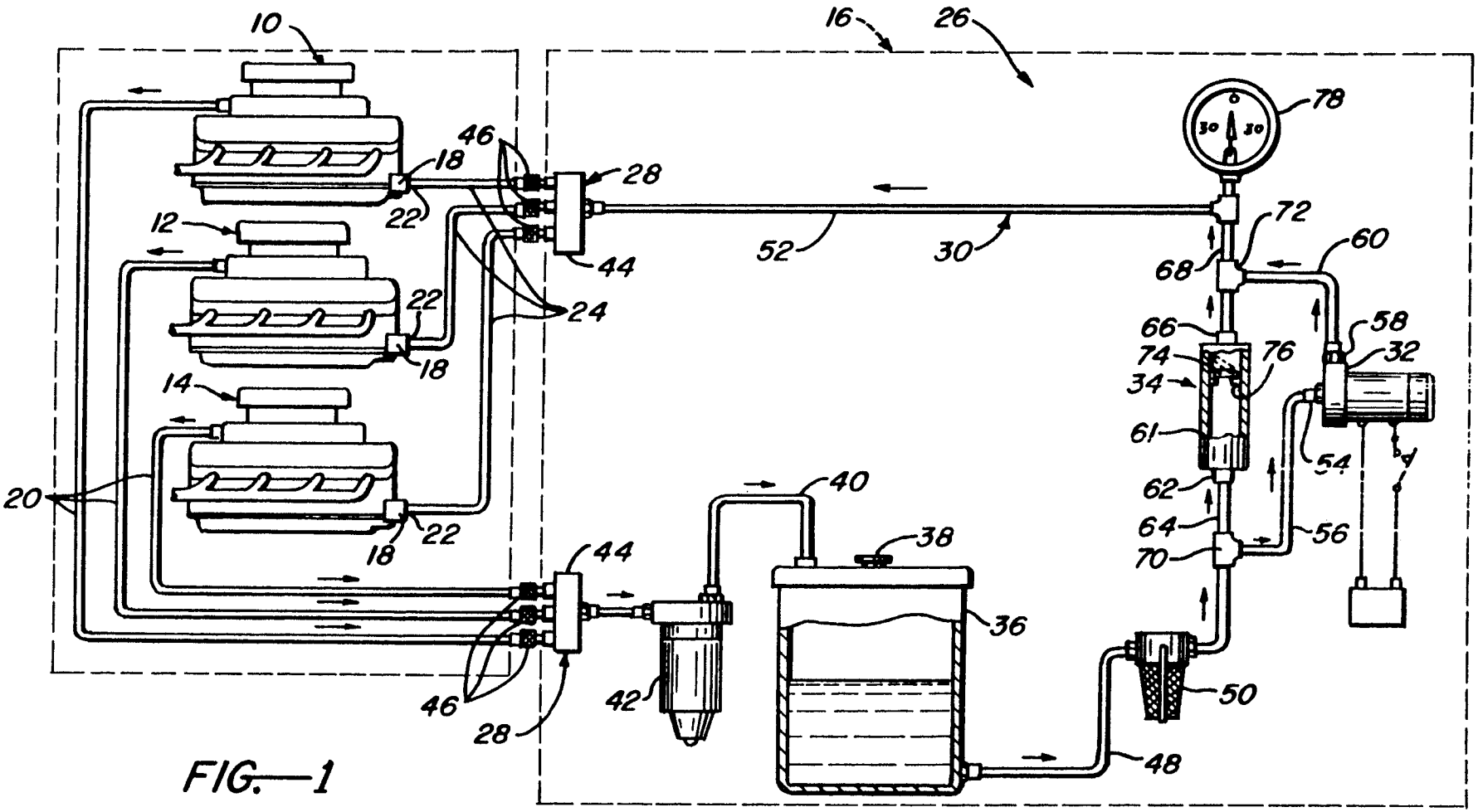

Turning now to the drawing, there are illustrated three conventional internal combustion engines 10, 12, and 14 connected to engine conditioning apparatus 16 according to this invention. The engines 12 may be either fuel injected engines or carburetted engines. The particular engines illustrated are of the type whose fuel pumps 18 deliver excess fuel to the engine fuel input means (fuel injectors or carburetors-not shown), that is, a greater volume of fuel than is introduced into the engine cylinders. The excess fuel is utilized to cool and lubricate the fuel input means and is then recycled back to the fuel pumps through fuel return lines 20. Fuel pumps 18 have inlets 22 which are normally connected to engine fuel tanks (not shown) through fuel infeed lines 24.

During normal operation of the engines 10, 12, 14, the engine fuel pumps 18 pump fuel from the engine fuel tanks through the engine fuel input lines 24 to the engine fuel input means which then introduce the fuel into the engine cylinders to power the engines. In a fuel injected engine, the fuel input means 22 comprise fuel injectors which inject fuel at high pressure into the individual engine cylinders. In a carburetted engine, the fuel input means comprises a carburetor which atomizes the fuel and mixes the atomized fuel with the intake air entering the cylinders.

As explained in more detail below, the engine conditioning apparatus 16 of this invention is adapted for connection to the engine fuel infeed lines 24 and to the engine excess fuel return lines 20 in a manner which permits the apparatus to be quickly and easily connected to and disconnected from the engines. In this regard, it should be noted that the engines to be conditioned are normally automobile engines, and the conditioning apparatus is located at a fixed service facility to which automobiles are driven for engine conditioning service. When connecting the conditioning apparatus to the engines, air normally enters the engine fuel lines. Accordingly, art is neccessary to prime the engines to start them. As explained in more detail presently, the engine conditioning apparatus 16 is operable to first prime the engines while they are being cranked by their starters in order to start the engines and then feed combustible engine conditioning or cleaning fuel to the fuel pumps of the running engine to simultaneously power and clean the engines. The preferred conditioning fuel comprises a combustible mixture of standard engine fuel and a carbon removing agent, such as glycol ether EB, aromatic solvent blend, ammonia soap, petroleum distillate, or an alcohol derivitive.

The engine conditioning apparatus 16 comprises fuel handling means 26, and coupling means 28 for connecting the fuel handling means to the engine fuel infeed and return lines 24, 20 in such a way as to permit fuel flow between the fuel handling means and engines. The apparatus fuel handling means 26 comprises fuel transport means 30 for initially conducting priming fuel from the conditioning apparatus to the engines 10, 12, 14 to initially prime them while they are being cranked by their starters and then conducting engine conditioning fuel to the engines to both remove carbon deposits from and power the engines. Included in the fuel transport means 30 is a motor driven priming pump 32 which pumps the priming fuel to the engines to initially prime and start them and fuel by-pass means 34 for conducting conditioning fuel to the running engines along a flow path which bi-passes the priming pump. As noted earlier and will become evident from the ensuing description, by-passing the priming pump in this way removes the pump, and thereby the flow restriction created by the pump, from the fuel flow path during conditioning of the engines. This substantially increases the maximum conditioning fuel delivery rate of the conditioning apparatus and permits simultaneous conditioning or cleaning of several engines.

Referring now in more detail to the engine conditioning apparatus 16 illustrated, its fuel transport means 30 comprises a fuel storage means in the form of a refillable tank 36 for containing a sufficiently large supply of fuel to simultaneously prime and condition or clean the maximum number of engines for which the apparatus is rated, i,e, three engines in the case of the apparatus illustrated. This tank has a top filler opening 38 through which the fuel may be introduced into the tank in the manner explained later.

Extending from the top of the fuel tank 36 is a fuel line 40 containing a fuel filter 42 and terminating in a coupling means 28. This coupling means comprises a manifold 44 connected to the fuel line 40 and mounting quick disconnect couplings 46 which form multiple fuel inlets on the manifold for connection to the engine fuel return lines 20. Extending from the bottom of the fuel tank 36 is a fuel line 48 containing a fuel strainer 50. Fuel line 48 connects to a fuel line 52 through both the priming pump 32 and fuel by-pass means 34. As explained below, the pump and by-pass means are connected in parallel between adjacent ends of the fuel lines 48, 52. The opposite end of the fuel line 52 terminates in a coupling means 28 identical to that of fuel line 40 and including a manifold 44 and quick disconnect couplings 46 which form multiple fuel outlets on the manifold for connection to the engine fuel infeed lines 24.

The priming pump 32 has an inlet 54 connected to one end of a pump intake line 56 and an outlet 58 connected to one end of a pump discharge line 60. The pump by-pass means 44 comprises a by-pass check valve including a generally tubular body 61 having at one end an inlet 62 connected to one end of a valve inlet line 64 and at its opposite end an outlet 66 connected to one end of valve outlet line 68. The opposite ends of the priming pump intake line 56 and by-pass valve inlet line 64 are connected by a T-coupling 70 to the adjacent end of the fuel line 48. The opposite ends of the priming pump discharge line 60 and by-pass valve outlet line 68 are connected by a T-coupling 72 to the adjacent end of the fuel line 52.

Pivotally mounted within the tubular by-pass valve body 61 is a valve flapper 74 which is movable into and from seating engagement with a valve seat 76 about the flow passage through the body. This flapper is arranged to open when the fuel pressure at the valve inlet 62 exceeds the fuel pressure at the valve outlet 66 to permit fuel flow through the valve from the inlet to the outlet. The flapper closes when the fuel pressure at the valve outlet 66 exceeds the fuel pressure at the valve inlet 62 to block flow through the valve from the outlet to the inlet.

From the above description and the drawing, it will be seen that the priming pump inlet 54 and the by-pass valve inlet 62 are both connected to the bottom of the fuel tank 36 through the common fuel line 48. The priming pump outlet 58 and the by-pass valve outlet 66 are both connected to the engine fuel infeed lines 24 through the common fuel lines 68, 52 and the upper coupling manifold 44 in the drawings. The engine excess fuel return lines 20 are connected to the top of the fuel tank 36 through the lower coupling manifold 44 and the fuel line 40. The engine fuel systems and the engine conditioning apparatus 16 thus form a closed fuel flow path from the fuel tank 36, through the engines 10, 12, 14 in parallel, and back to the fuel tank. The priming pump 32 and pump by-pass valve 34 are arranged in parallel in this flow path. The upper coupling manifold 44 in the drawing constitutes a fuel discharge manifold of the conditioning apparatus, and the lower manifold constitutes a fuel inlet manifold of the apparatus. A combination vaccum/pressure gauge 78 is connected to the fuel line 52 to measure the fuel pressure in the flow path between the engine fuel pumps 18 and the priming pump 32 and by-pass valve 34.

The engine conditioning apparatus 16 is connected to the engines 10, 12, 14 to be conditioned by uncoupling the engine fuel intake and excess fuel return lines 24, 20 from their mating portions (not shown) of their respective engine fuel systems and connecting these lines to the upper and lower apparatus discharge and inlet coupling manifolds 44, respectively, of the apparatus. During this connection of the conditioning apparatus to the engines, fuel will drain from and air will enter the engine fuel lines and the apparatus manifolds and adjacent apparatus fuel lines. The engines thus lose their prime during connection of the aparatus to the engines. The conditioning apparatus is readied for operation by filling its fuel tank 36 with fuel in a manner in which will be explained presently.

Operation of the conditioning apparatus 16 is initiated by operating its priming pump 32 to pump fuel from the fuel tank 36 to the engines 10, 12, 14 while they are being cranked by their starters. This cranking operation drives the engine fuel pumps 18 which are then ineffective to pump fuel owing to the air in the fuel lines. As a consequence, the down stream side of the flapper 74 in the priming pump by-pass valve 34 (i.e. the upper side of the flapper as the valve is viewed in the drawing) is exposed to the relatively high fuel pressure at the discharge side of the priming pump, and the opposite up stream (lower) side of the flapper is exposed to the relatively low fuel pressure at the intake side of the pump. The resulting pressure differential across the flapper moves the latter to its broken line closed position in the drawing to block recirculating fuel flow from the pump discharge, through the valve, to the valve inlet.

Closure of the by-pass valve 34 enables the priming pump 32 to pump fuel from the fuel tank 36 to the engines 10, 12, 14 to prime and start the cranking engines. When the engines start running, their fuel pumps 18 commence pumping fuel from the fuel tank 36 to the engines, thereby permitting the priming pump 32 to be stopped. The resulting pumping action of the engine fuel pumps produces a reversed pressure differential across the by-pass valve flapper 74 which moves the flapper to its broken line open position in the drawings. Fuel flow then occurs from the fuel tank 32 to the engines through the by-pass valve 34 with the result that the priming pump does not impose any flow restriction in the fuel flow path to the engines. This, in turn, increases the maximum fuel delivery rate of the conditioning apparatus 16 sufficiently to permit simultaneous cleaning of several engines. If the combined pumping rate of the engine fuel pumps 18 exeeds the pumping rate of the priming pump 32, as will generally be the case, the pumping action of the engine fuel pumps will effect opening of the flapper valve 34 to by-pass the priming pump even while the priming pump is operating. During continued operation of the engines 10, 12, 14, the engine cleaning fuel is delivered by the engine fuel pumps to the engine fuel input means (i.e. fuel injectors or carburetors) which introduce the fuel into the engine cylinders to power the engines. The excess fuel output from the engine fuel pumps is recirculated back to the fuel tank 36 through the engine fuel lines 20 and the lower inlet manifold 44 of the conditioning apparatus.

The fuel tank 36 may be provided with priming and conditioning fuel in various ways. For example, the tank may initially contain normal engine fuel during the engine priming phase of the conditioning apparatus 16 and then conditioning fuel during the engine conditioning phase of the apparatus. In this case, the priming fuel and conditioning fuel are effectively different fuels which are used to prime the starting engines during priming phase (normal fuel) and to remove carbon from and power the running engines (conditioning fuel). The conditioning fuel may be provided by introducing into the tank at the start of the conditioning phase either premixed conditioning fuel or carbon cleaning agent(s) which mix with the normal fuel in the tank to form the conditioning fuel. Alternatively, the tank may contain only conditioning fuel which is used to both prime the engines during the priming phase and remove carbon from and power the engines during the conditioning phase. In this case the priming fuel and conditioning fuel are the same fuel. This conditioning fuel may be pre-mixed and then introduced into the tank, or the conditioning fuel components may be introduced into the tank separately and mixed within the tank.

The engine conditioning apparatus 16 is operated for a period of time sufficient to produce the desired carbon-free condition of the engines 10, 12, 14. This operating period may be timed by any suitable timer (not shown) external to or incorporated in the apparatus. The timer may include an alarm for signalling completion of the cleaning operation. Removal of carbon deposits from the engines also produces fuel pressure changes which may be observed on the vaccum/pressure gauge 78 to obtain an indication of engine cleanliness. If neccessary, additional fuel may be introduced into the tank 36 during the engine cleaning operation.

I claim:

1. Engine conditioning apparatus for removing internal carbon deposits from the fuel system of an internal combustion engine including a fuel pump having an inlet by initially feeding priming fuel to said pump inlet to prime the engine while it is being cranked, thereby to start the engine and effect driving of said fuel pump by the engine, and then utilizing said fuel pump to circulate through the engine fuel system engine conditioning fuel capable of both removing said carbon deposits and combustion in the engine to power the engine, said apparatus comprising:

fuel handling means including fuel storage means for containing said fuel, connecting means for connecting said fuel handling means to the inlet of said engine fuel pump for fuel flow from said storage means to said fuel pump inlet, and wherein said fuel handling means comprises a priming pump for pumping priming fuel from said fuel storage means to said engine fuel pump inlet during cranking of said engine to prime and start the engine, and by-pass means for conducting engine conditioning fuel from said fuel storage means to said engine fuel pump without passing through said priming pump when said engine is running to both remove carbon from and power the engine without restriction of the conditioning fuel flow by said priming pump.

2. Engine conditioning apparatus according to claim 1 wherein:

said engine fuel pump discharges excess fuel which is used for cooling and lubricating purposes, said engine includes an excess fuel return line through which said excess fuel is conducted from the engine for recycling back to said fuel pump, and said fuel handling means includes a fuel line for conducting said excess fuel from said engine fuel line back to said fuel storage means.

3. Engine conditioning apparatus according to claim 1 wherein:

said by-pass means is arranged in parallel with said priming pump.

4. Engine conditioning apparatus according to claim 1 wherein said fuel storage means comprises a tank for containing said fuel, said connecting means comprises outlet means through which fuel flow occurs from said apparatus to said engine fuel pump inlet, and said priming pump and by-pass means are connected in parallel between said tank and said outlet means.

5. Engine conditioning apparatus according to claim 4 wherein:

said by-pass means comprises a by-pass valve.

6. Engine conditioning apparatus according to claim 5 wherein:

said priming pump and by-pass valve have inlets connected to said tank through a first common fuel line and outlets connected to said outlet means through a second common fuel line, whereby operation of said priming pump during cranking of said engine creates one relationship between the fuel pressures at said by-pass valve inlet and outlet, and operation of said engine fuel pump during running of said engine creates another relationship between said fuel pressures at said by-pass valve inlet and outlet, and said by-pass valve includes valve means responsive to said pressure relationships in such a way that said valve means closes to block fuel flow from said priming pump outlet through said by-pass valve to said priming pump inlet when said priming pump is operating to prime said engine and opens to permit fuel flow through said by-pass valve from said fuel tank to said engine fuel pump when said engine is running.

7. Engine conditioning apparatus according to claim 6 wherein:

said valve means comprises a valve flapper.

8. Engine conditioning apparatus according to claim 6 wherein:

said engine fuel pump discharges excess fuel which is used for fuel system cooling and lubricating purposes, and said engine includes an excess fuel return line through which said excess fuel is conducted from the engine for recycling back to said fuel pump, and said fuel handling means includes additional connecting means for connecting said fuel tank to said engine fuel line for excess fuel flow from said engine to said tank.

9. Engine conditioning apparatus according to claim 8 wherein:

said outlet means comprise multiple couplings for connection to the fuel pump inlets, respectively, of several engines in parallel, and said additional connecting means comprise multiple couplings for connection to said fuel lines, respectively, of said several engines.

10. Engine conditioning apparatus according to claim 4 wherein:

said outlet means comprise multiple couplings for connection to the fuel pump inlets, respectively, of several engines in parallel.

11. In combination:

engine means including at least one internal combustion engine having a fuel system including a fuel pump having an inlet, engine conditioning apparatus for removing internal carbon deposits from the fuel system of each engine by initially feeding priming fuel to its fuel pump inlet to prime the engine while it is being cranked, thereby to start the engine and effect driving of its fuel pump by the engine, and then utilizing the engine fuel pump to circulate through the engine fuel system engine conditioning fuel capable of both removing said carbon deposits and combustion in the engine to power the engine, and wherein said engine conditioning apparatus comprises fuel handling means including fuel storage means for containing said fuel, connecting means connecting said fuel handling means to the inlet of each engine fuel pump for fuel flow from said storage means to the respective fuel pump inlet, a priming pump for pumping priming fuel from said fuel storage means to each engine fuel pump inlet during cranking of the respective engine to prime and start the engine, and by-pass means for conducting engine conditioning fuel from said fuel storage means to each engine fuel pump without passing through said priming pump when the respective engine is running to both remove carbon from and power each engine without restriction of the conditioning fuel flow by said priming pump.

12. The combination according to claim 11 wherein:

each engine fuel pump discharges excess fuel which is used for cooling and lubricating purposes, and each engine has an excess fuel return line through which said excess fuel is conducted from the respective engine for recycling back to its fuel pump, and said fuel handling means includes a fuel line for conducting said excess fuel from each engine fuel line back to said fuel storage means.

13. The combination according to claim 11 wherein:

said by-pass means is arranged in parallel with said priming pump.

14. The combination according to claim 11 wherein:

said fuel storage means comprises a tank, said connecting means comprises outlet means through which fuel flow occurs from said tank to each engine fuel pump inlet, and said priming pump and by-pass means are connected in parallel between said tank and said outlet means.

15. The combination according to claim 14 wherein:

said by-pass means comprises a by-pass valve.

16. The combination according to claim 15 wherein:

said priming pump and by-pass valve have inlets connected to said tank through a first common fuel line and outlets connected to said outlet means through a second common fuel line, whereby operation of said priming pump during cranking of each engine creates one relationship between the fuel pressures at said by-pass valve inlet and outlet, and operation of each engine fuel pump during running of each engine creates another relationship between said fuel pressures at said by-pass valve inlet and outlet, and said by-pass valve includes valve means responsive to said pressure relationships in such a way that said valve means closes to block fuel flow from said priming pump outlet through said by-pass valve to said priming pump inlet when said priming pump is operating to prime each engine and opens to permit fuel flow through said by-pass valve from said fuel tank to each engine fuel pump when its engine is running.

17. The combination according to claim 16 wherein:

said valve means comprises a valve flapper.

18. The combination according to claim 16 wherein:

each engine fuel pump discharges excess fuel which is used for cooling and lubricating purposes, and each engine includes an excess fuel return line through which said excess fuel is conducted from the the respective engine for recycling back to its fuel pump, and said fuel handling means includes additional connecting means for connecting said fuel tank to each engine fuel line for excess fuel flow from the respective engine to said tank.

19. The combination according to claim 18 wherein:

said engine means comprise a plurality of engines, and said outlet means and connecting means comprise multiple couplings for connection to the fuel pump inlets and the excess fuel return lines, respectively, of the several engines.

20. The combination according to claim 11 wherein:

said engine means comprise a plurality of engines, and said connecting means comprise multiple couplings for connection to the fuel pump inlets of the several engines, respectively.

21. The method of removing carbon deposits from the fuel system of an internal combustion engine including a fuel pump having a fuel inlet, comprising the steps of:

operating a priming pump to pump priming fuel to said engine fuel pump inlet while said engine is being cranked to start the engine and thereby drive said fuel pump, and conducting to the driven fuel pump, along a flow path which by-passes said priming pump, an engine conditioning fuel capable of removing said carbon deposits and combustion in the engine to power the engine.

22. Engine conditioning apparatus for performing at least one of the following functions: (a) priming a plurality of internal combustion engines having fuel systems including fuel pumps having inlets by feeding priming fuel to the fuel pump inlets while the engines are being cranked to start the engines and thereby effect driving of the fuel pumps by their respective engines, and (b) while the engines are running, utilizing their fuel pumps to circulate through the engine fuel systems conditioning fuel capable of both removing carbon deposits from the fuel systems and combustion in the engines to power the engines, said apparatus comprising:

fuel storage means for containing said fuel, coupling means including multiple fuel outlets, and couplings for connecting said fuel outlets to the inlets, respectively, of the engine fuel pumps, and fuel transport means including a priming pump connecting said fuel storage means to said multiple fuel outlets in a manner which permits use of said engine conditioning apparatus in at least one of the following modes: an engine priming mode in which said priming pump is operable to pump priming fuel from said fuel storage means through said multiple fuel outlets, and an engine conditioning mode in which said fuel transport means is conditioned to conduct engine conditioning fuel from said fuel storage means through said multiple fuel outlets without restriction by said priming pump, whereby said engine conditioning apparatus may be used in said priming mode to prime the engines while they are being cranked, thereby to start the engines, and said conditioning apparatus may be used in said engine conditioning mode to permit the fuel pumps of the running engines to pump conditioning fuel from said fuel storage means to the running engines for powering the running engines and cleaning carbon deposits from the engine fuel systems.

23. Engine conditioning apparatus according to claim 22 wherein:

said apparatus is adapted for use with internal combustion engines of the kind whose fuel pumps discharge excess fuel which is used for cooling and lubricating purposes, and whose fuel systems include excess fuel return lines through which said excess fuel is recycled back to the respective engine fuel pumps, and said conditioning apparatus includes coupling means including multiple inlets and couplings for connecting said multiple inlets to the excess fuel return lines, respectively, of the engine fuel systems, and a fuel line connected at one end to said inlet connecting means and at the other end to said fuel storage means for conducting fuel entering said multiple inlets to said fuel storage means.

24. Engine conditioning apparatus according to claim 23 wherein:

said fuel transport means includes by-pass means for conducting engine conditioning fuel from said fuel storage means to said multiple fuel outlets without passing through said priming pump in said engine conditioning mode.

25. Engine conditioning apparatus according to claim 22 wherein:

said fuel transport means includes by-pass means for conducting engine conditioning fuel from said fuel storage means to said multiple fuel outlets without passing through said priming pump in said engine conditioning mode.

26. In combination:

engine means including a plurality of internal combustion engines having fuel systems including fuel pumps having inlets, engine conditioning apparatus for performing at least one of the following functions: (a) priming said engines by feeding priming fuel to the engine fuel pump inlets while the engines are being cranked, thereby to start the engines and effect driving of the engine fuel pumps by their respective engines, (b) utilizing the fuel pumps of the running engines to circulate through the engine fuel systems engine conditioning fuel capable of both removing carbon deposits from the fuel system and combustion in the engines to power the engines, and wherein said engine conditioning apparatus comprises fuel storage means for containing said fuel, coupling means including multiple fuel outlets connected to said fuel pump inlets, respectively, fuel transport means including a priming pump connecting said fuel storage means to said multiple fuel outlets in a manner which permits use of said engine conditioning apparatus in at least one of the following modes: an engine priming mode in which said priming pump is operable to pump priming fuel from said fuel storage means to said engine fuel pumps through said multiple fuel outlets during cranking of the engines for priming and starting the engines, and an engine conditioning mode in which said fuel transport means is conditioned to conduct engine conditioning fuel from said fuel storage means to said engine fuel pumps through said multiple fuel outlets without restriction by said priming pump to permit the fuel pumps of the running engines to pump conditioning fuel from said fuel storage means to the running engines for powering the running engines and cleaning carbon deposits from the engine fuel systems.

27. The combination according to claim 26 wherein:

the engine fuel pumps discharge excess fuel which is used for cooling and lubricating purposes, the engine fuel systems include excess fuel return lines, respectively, through which said excess fuel is recycled back to the respective engine fuel pumps, and said engine conditioning apparatus comprises coupling means including multiple fuel inlets connected to said excess fuel return lines, respectively, and a fuel line connected at one end to said inlet connecting means and at the other end to said fuel storage means for conducting excess fuel from the excess fuel return lines to said fuel storage means.

28. The combination according to claim 27 wherein:

said fuel transport means includes by-pass means for conducting engine conditioning fuel from said fuel storage means to said multiple fuel outlets without passing through said priming pump in said engine conditioning mode.

29. The combination according to claim 26 wherein:

said fuel transport means includes by-pass means for conducting engine conditioning fuel from said fuel storage means to said multiple fuel outlets without passing through said priming pump in said engine conditioning mode.

* * * * *